US006050061A

United States Patent [19]

Todd et al.

[11] Patent Number: 6,050,061

[45] Date of Patent: Apr. 18, 2000

[54] POUCH CARRYING APPARATUS

[75] Inventors: James E. Todd; Thomas E. Brooker; Gregory A. Conn, all of Sarasota, Fla.

[73] Assignee: Klockner Bartelt, Inc., Sarasota, Fla.

[21] Appl. No.: 09/185,342

[22] Filed: Nov. 3, 1998

[51] Int. Cl.[7] ..... B65B 9/08; B65B 59/02

[52] U.S. Cl. ..... 53/455; 53/201; 53/249; 53/562

[58] Field of Search ..... 53/201, 562, 455, 53/249, 250, 257; 198/803.4, 803.3, 803.11

[56] References Cited

U.S. PATENT DOCUMENTS

| | | | |
|---|---|---|---|
| 3,182,432 | 5/1965 | Canfield | 53/112 |
| 3,325,977 | 6/1967 | Kirsten | 53/250 |
| 3,381,446 | 5/1968 | Marchand | 53/187 |
| 3,430,414 | 3/1969 | Ludwig et al. | 53/79 |
| 3,553,934 | 1/1971 | Johnson et al. | 53/201 X |
| 3,568,402 | 3/1971 | Lense et al. | 53/384 |
| 3,708,952 | 1/1973 | Schulze et al. | 53/112 B |
| 4,033,093 | 7/1977 | Mencacci | 53/112 B |
| 4,156,336 | 5/1979 | Tabaroni et al. | 53/562 |
| 4,306,400 | 12/1981 | Coleman et al. | 53/373 |
| 4,418,512 | 12/1983 | Johnson | 53/434 |
| 4,423,583 | 1/1984 | Carey | 53/373 |
| 4,436,576 | 3/1984 | Seiden | 156/543 |
| 4,580,473 | 4/1986 | Seiden et al. | 83/23 |
| 4,736,572 | 4/1988 | Fang et al. | 53/512 |
| 4,956,964 | 9/1990 | Jones et al. | 53/570 |
| 5,058,364 | 10/1991 | Seiden et al. | 53/455 |
| 5,353,573 | 10/1994 | Durrant | 53/410 |
| 5,502,951 | 4/1996 | Oliverio et al. | 53/201 X |
| 5,544,738 | 8/1996 | Klopfenstein | 53/257 X |

*Primary Examiner*—James F. Coan
*Attorney, Agent, or Firm*—Leydig, Voit & Mayer, Ltd.

[57] ABSTRACT

Pouch filling apparatus for carrying pouches through a pouch filler. The apparatus has leading and trailing clamps which are mounted on independent endless carriers. The endless carriers are driven at the same speed, but are controlled to maintain a set lag distance between the leading and trailing clamps. The lag distance may be adjusted to thereby adapt the apparatus for pouches of various sizes. The apparatus further incorporates a single retard arm and a single advance arm for moving the leading clamp between opened and closed pouch positions, respectively. The advance arm is located upstream of the pouch filler to move the leading clamp into the open pouch position for filling. The retard arm is located downstream of the pouch filler and moves the trailing clamp to the closed pouch position for sealing. The retard and advance arms are independently servo controlled to adapt the apparatus for pouches of various sizes and for continuous and intermittent operation.

15 Claims, 11 Drawing Sheets

102
104
12
172
102
51
12
54
56
14

102
12
104
172
102
104
54
12
51
56
14

102
12
130
152
104
134
140
132
136

POUCH CARRYING APPARATUS

FIELD OF THE INVENTION

The present invention generally relates to packaging machines, and more particularly relates to apparatus for carrying pouches through a pouch filler.

BACKGROUND OF THE INVENTION

Packaging machines are known in which a continuous web of material is converted into a plurality of individual pouches. The continuous web of material is folded in half over a plow to form two continuous side panels joined by a bottom fold. The folded web is passed through a series of seal bars which seal the side panels together at predetermined locations to form a strip of pouches interconnected by transverse seals. A cutter cuts through each transverse seal to form individual pouches with unsealed top edges.

The individual pouches separated from the web are transferred to a pouch filling station. The top edges of the pouches are closed when transferred, with the side panels substantially flat. In the pouch filling station, the individual pouches are typically carried in clamps which reposition the pouches so that the top edges are open as they pass through a pouch filler. The pouch filler then fills the pouches with product as the top edges are held open. The clamps subsequently shift back to close the pouches downstream of the pouch filler. The pouches are then sealed and collected for transport.

The type of product being packaged often determines whether the packaging process should use a continuously or intermittently advancing web. Certain products, such as hard candy, require a fill based on weight instead of volume. Scale fillers require relatively long periods to fill a pouch. As a result, slower cycle continuous motion or intermittent motion is required to provide additional fill time. More free flowing products, such as sugar, may be dispensed using a diving funnel suitable for filling continuously advancing pouches. A machine capable of running both continuously and intermittently has not heretofore been known.

It is advantageous for a packaging machine to be capable of forming different sized pouches. For example, when packaging a particular product, it may be desirable to provide small and large pouches of the product. Accordingly, it is important that the packaging machine, including the pouch carrying apparatus, be adjustable for such different sized pouches.

Most conventional pouch carrying apparatus are incapable of adjustment, or require a significant amount of labor and down time to adjust for different pouch widths. Certain pouch carrying apparatus are only suitable for a single pouch size. Some of these machines, for example, have clamps directly attached to a single chain or chain set. To carry a different sized pouch, at least one clamp of each associated clamp pair must be removed and reattached at a different point along the chain. In the alternative, the entire chain set must be removed and replaced with a second chain set already having properly spaced clamps. As a result, adjusting such carrying apparatus for different sized pouches is overly difficult and time consuming.

Other pouch carrying apparatus, such as that disclosed in U.S. Pat. No. 4,956,964 to Jones, use a plurality of pouch-carrying frames interposed along a single chain or chain set. Each frame has a fixed first jaw and moveable second jaw, the jaws holding opposite sides of a pouch. The moveable second jaw is slideably mounted on rods so that the space between the first and second jaws may be adjusted, thereby adapting the frame to carry different sized pouches. As noted in Jones, however, the range of adjustment is limited by the frame size. For example, as stated at Col. 6, line 67 to Col. 7, line 4 of the '964 patent, a gripper unit having a 6-inch pitch (that is, a frame mounted on pin sets that are spaced six-inches apart) is suitable for handling pouches within a range of about 2.5 inches to 4.5 inches. For pouch sizes outside this range, the 6-inch pitch frames must be removed and replaced with different sized frames. Furthermore, to adjust each frame within the appropriate range, the moveable jaw of each frame must be individually repositioned. As a result, pouch width change overs are overly time consuming.

Furthermore, the machine disclosed in the '964 patent does not reliably indicate the position of both clamps. The machine can ascertain where the frame is and, therefore, where the fixed clamp is located. The machine can not, however, similarly determine where the movable clamp is because that clamp is positioned on the rods according to pouch size.

Pouch carrying apparatus must not only be capable of accepting different pouch sizes, but must also be capable of adjusting the relative distance between associated pairs of clamps to open and close the pouch for filling and sealing operations. As noted above, the severed pouches are typically transferred in a closed condition into the clamps of the pouch carrying apparatus. Before reaching the pouch filler, the spacing between each associated pair of clamps is reduced so that the side walls of each pouch bow outward to provide an open pouch. Each pouch is held in the open position as the pouch is filled. After filling, the relative distance between each clamp in an associated pair of clamps is increased back to approximately the original position to again provide a closed pouch. Each pouch is then carried through sealer rolls to seal the top end of the pouch.

It is overly difficult, however, to adjust the pouch opening and closing operations for different pouch widths. For example, the frame of the above-mentioned U.S. Pat. No. 4,956,964 to Jones supports a lever arm which is attached to the moveable jaw. As a result, the cams must be positioned properly along the path so that the moveable clamp is repositioned at the desired locations before and after the pouch filler. The cams must further have the appropriate profile so that the moveable clamp is repositioned the appropriate distance. The desired repositioning distance changes according to the pouch size. Accordingly, to run a different pouch size, each of the cams must be repositioned so that it is at the proper location and has the appropriate profile. As a result, it is overly burdensome and time consuming to adjust the pouch opening and closing operations.

SUMMARY OF THE INVENTION

A general aim of the present invention is to provide a pouch carrying apparatus which is quickly and easily adjusted for pouches of different sizes.

In that regard, it is an objection of the present invention to provide a pouch carrying apparatus in which the distance between clamps in an associated pair of clamps is quickly and easily adjusted.

A related object of the present invention is to provide a clamp structure that is capable of quick and easy adjustment for a wide range of pouch sizes.

In light of the above, the present invention provides a pouch carrying apparatus having associated pairs of leading and trailing clamps, the leading clamps carried by a first endless carrier and the trailing clamps carried by a second, separate endless carrier. The trailing clamps are controlled to trail the leading clamps by a lag distance. A control drives the first and second endless carriers at the same speed but allows adjustment therebetween to alter the lag distance between all leading and all trailing clamps simultaneously. As a result, the pouch carrying apparatus of the present invention provides running adjustment for various pouch widths.

The packaging machine of the present invention also provides actuators for performing the pouch opening and closing operations for each pair of clamps. One clamp of each associated pair of clamps is fixed while the other clamp is controllably repositionable to open and close the pouch. In a closed pouch position, the clamps of each pair are separated by the pouch width. In this position, the top edge of the pouch held by the clamps is closed. In an open pouch position, the moveable clamp is transported toward the fixed clamp to open the pouch for filling. An upstream actuator is positioned before the pouch filler to engage and drive the moveable clamp from the closed pouch position to the open pouch position. After the pouch has been filled in the pouch filler, a downstream actuator engages and drives the moveable clamp from the open pouch position back to the closed pouch position.

These and other aims, objectives, and features of the invention will become more apparent from the following detailed description when taken in conjunction with the accompanying drawings.

Figure 1:
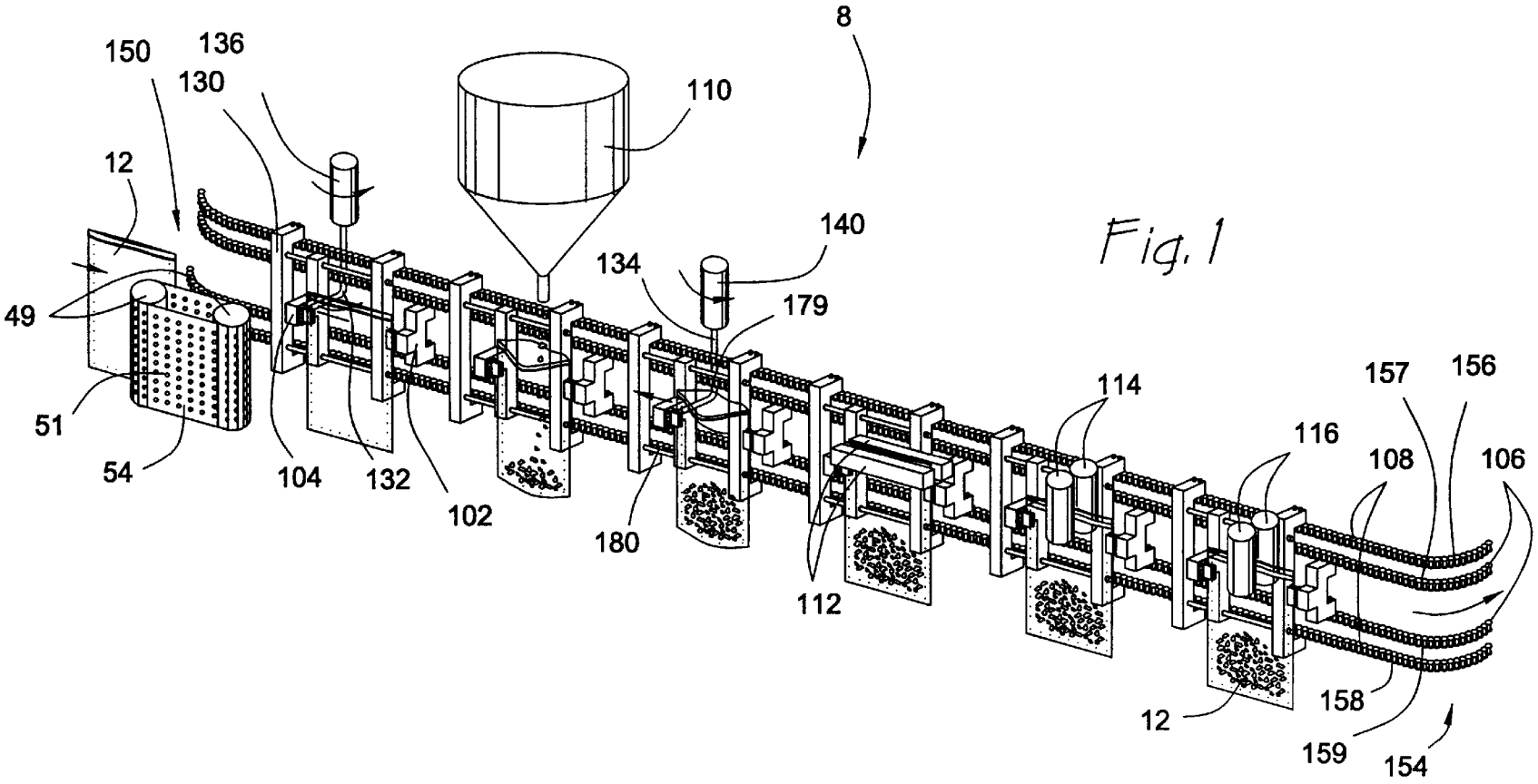
FIG. 1 is a partially schematic view in perspective of a pouch filling section in accordance with the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Figure 2:
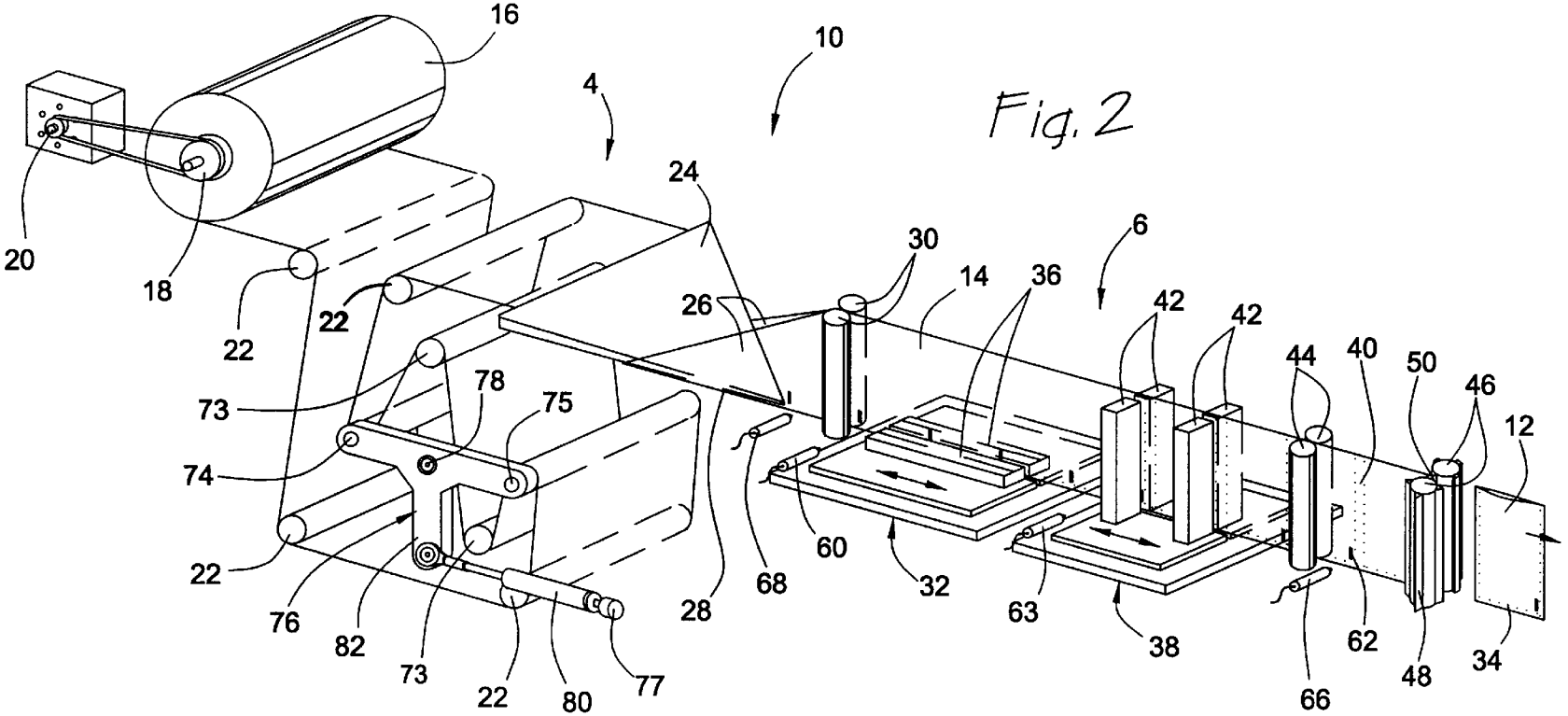
FIG. 2 is a partially schematic view in perspective of web unwind and sealing sections of a pouch forming machine for use with the pouch filling section of FIG. 1.

Referring now to the drawings, a packaging machine 10 for forming, filling, and sealing pouches is illustrated in FIGS. 1 and 2. The machine 10 includes an infeed section 4 (FIG. 2), a sealing section 6 (FIG. 2), and a pouch filling section 8 (FIG. 1). A continuous web 14 of material is dispensed from the infeed section 4. The web 14 is formed of sealable material, which includes heat-sealable material (such as polyethylene or polypropylene) and pressure-sensitive cold seal film. The web 14 is pulled through the sealing section which forms pouch seals in the web and cuts formed pouches 12 from the web. The pouch filling section 8 (FIG. 1) receives the individual pouches 12 and carries them through a pouch filler 110. The filled pouches are then sealed and collected for distribution.

The infeed and sealing sections 4, 6 will first be described. The planar web material is typically supplied as a wound roll 16. The infeed section 4 has a reel 18 for supporting the roll 16. The reel 18 rotates to unwind the roll 16, thereby dispensing the material as the web 14. The reel 18 may be conventionally controlled or may have a dedicated reel motor 20 for varying an unwind speed. The web 14 is threaded over tension rollers 22 and a plow assembly 24 for folding the web to form side panels 26 joined at a common bottom edge 28. As illustrated in FIG. 2, the bottom edge 28 is formed with a V-shape. The plow assembly 24 may also include a gusset blade (not shown) for forming a W-shaped bottom edge. The folded web 10 is passed through a pair of infeed rolls 30 to cleanly define the fold lines in the web.

The web 14 next travels through the sealing section 6 of the machine 10 in which any of a number of pouch forming operations take place. In accordance with the embodiment illustrated in FIG. 2, the web 14 first passes through a bottom or first seal station 32 for forming a bottom seal 34, such as a delta seal, in the web 14. The web 14 next passes through a side seal station 38 which forms side seals 40 in the web. Upon leaving the side seal station 38, the web 14 is formed as a strip of pouches interconnected at the side seals 40. The seal stations 32, 38 may use heated seal bars to form seals in heat-sealable web material, or may use unheated seal bars when the web material is a cold seal film.

Figure 9A:
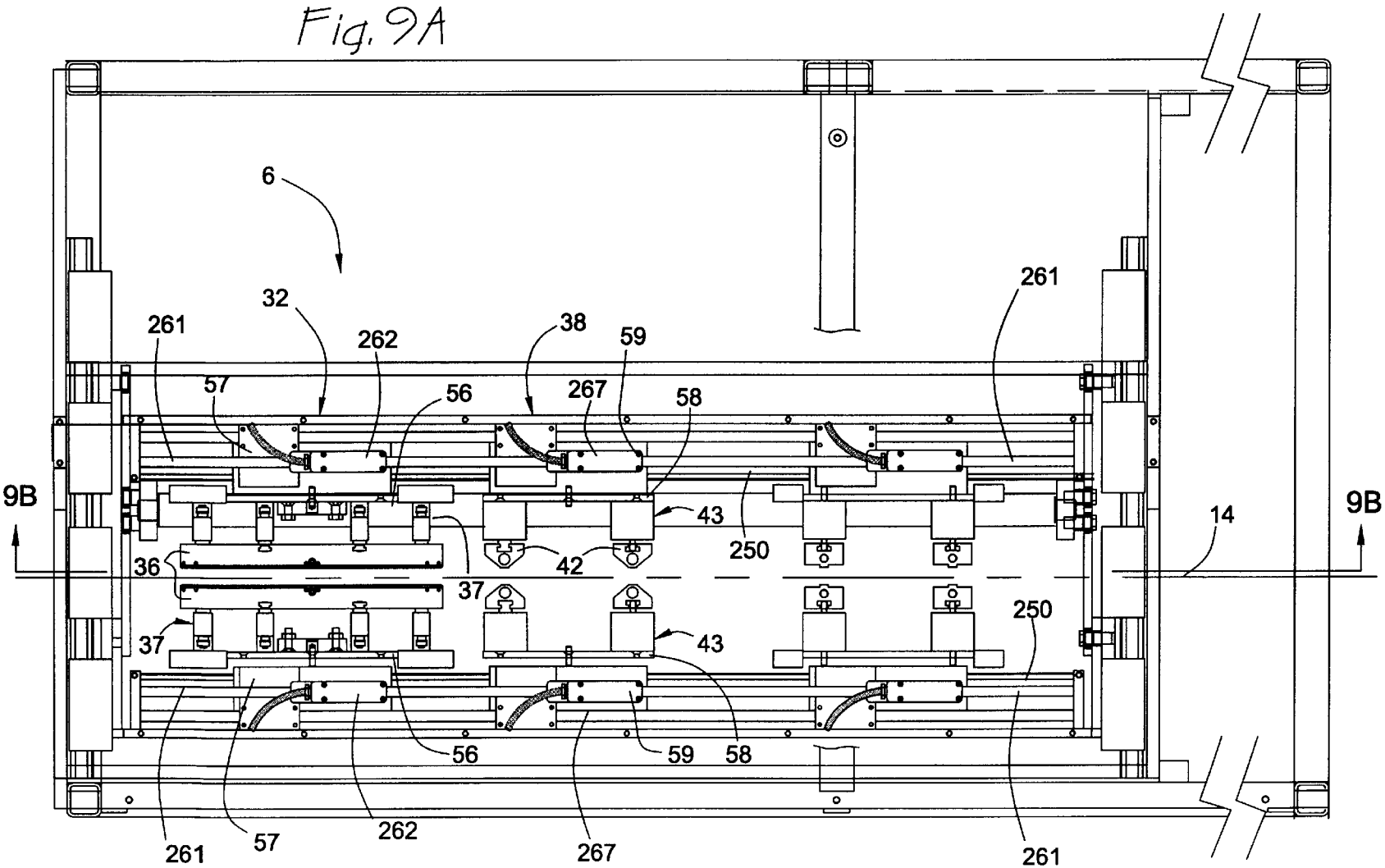
FIGS. 9A and B are enlarged top and side views of the preferred sealing section.

In the preferred embodiment, the bottom and side seal stations 32, 38 have seal bars which are operated in a box motion suitable for forming seals in both a continuously and an intermittently advancing web. In the currently preferred embodiment illustrated in FIGS. 9A and B, the bottom seal station, for example, has a pair of opposing bottom seal bars 36. A sub-support 37 is attached to the rear of each bottom seal bar 36, and each sub-support 37, in turn, is attached to a carriage 56. Each carriage 56 is adapted, such as by bearing sets, to slide along upper and lower tracks 250, 251 which extend along the length of the sealing section, as best shown in FIG. 9B. The sliding carriages 56 allow the bottom seal bars to translate back and forth parallel to the web path, defined herein as longitudinal motion.

The bottom seal bars 36 are further operable in a direction perpendicular to the web path, defined herein as lateral motion. The tracks 250, 251 are attached to end supports slidably mounted on rails 256, 257 extending perpendicular to the web path (FIG. 9B). As a result, the upper and lower tracks 250, 251 are operable in the lateral direction to reciprocate the bottom seal bars 36 into and out of engagement with the web path.

The side seal station 38 has a structure similar to that of the bottom seal station 32. As best shown in FIG. 9A, the side seal station comprises two pairs of opposing side bars 42. Sub-supports 43 are attached to the seal bars 42. The sub-supports 43, in turn, are attached to carriages 58 mounted for translation along the upper and lower tracks 250, 251. As a result, the side seal bars 42 are also operable in both longitudinal and lateral directions.

The combination of laterally moving sub-supports 37 and the longitudinally moving carriages 56 allows the bottom seal bars 36 to be driven in a box motion. The seal bars 36 begin in an initial position, in which the bars retracted from the web and the carriages 56 are at upstream positions. From the initial positions, the carriages 56 move downstream at a speed matching that of the web. With the carriages so moving, the sub-supports 37 actuate laterally inwardly so that the seal bars 36 engage the web. The bottom seal bars 36 are held in the inward position for a period of time sufficient to form a bottom seal as the carriages 56 continue to advance with the web 14. After the bottom seal 34 is formed, the seal bars 36 are retracted and the carriages 56 reverse direction. With the bottom seal bars 36 retracted, the carriages 56 move longitudinally upstream toward the initial positions, to repeat the box motion. The side seal station 38 is operated in a similar fashion.

In the preferred embodiment, variable speed motors are used to operate the bottom and side seal stations 32, 38 in the box motion. With respect to the bottom seal station 32, a variable speed motor 57 is coupled to each carriage 56 for driving the carriages longitudinally (FIGS. 9A and B). The motor 57 is preferably a linear motor having a magnetic rod 261 extending along the length of the sealing section 6. A motor housing 262 is mounted on the carriage 56 and operates back and forth along the rod 261. As a result, movement of the housing 262 along the rod 261 directly drives the attached carriage 56 longitudinally along the upper and lower tracks 250, 251. Motors 59 also drive the side seal carriages 58. The motors are preferably linear motors having housings 267 mounted on the same magnetic rods 261.

The lateral motion of the bottom and side seal bars 36, 42 is also preferably motor driven. A variable speed motor 33 is mechanically linked to the tracks 250, 251 to laterally reciprocate the tracks, thereby driving the seal bars 36, 42 into and out of engagement with the web 14 (FIG. 9B).

While the embodiment illustrated in FIGS. 9A and B is currently preferred, it will be appreciated that other arrangements may be used in accordance with the present invention, as long as the seal bars 36 are operable to translate in the longitudinal and lateral directions. For example, as schematically illustrated in FIG. 1, a single carriage mounted under the web may support seal bars on both sides of the web. In such an embodiment, a second motor must be mounted on each carriage to drive the lateral motion of the seal bars.

The seal bars are operated to engage the web as the web advances for both continuous and intermittent web motion. It will be appreciated that for intermittent web motion, the machine 10 of the present invention could be operated so that the seal bars engage the web during dwells, as is conventional. In the currently preferred embodiment, however, the seal bars always contact the web as the web advances, regardless of whether the web is advancing continuously or intermittently. By operating the seal stations in this manner, the seal bars will always be in contact with the web for a sufficient period of time to form the seals regardless of the dwell time between each intermittent advance of the web. Furthermore, the machine operates in a similar fashion for both continuous and intermittent web motion, thereby simplifying the controls and providing a machine which operates in a consistent manner.

Figure 10:
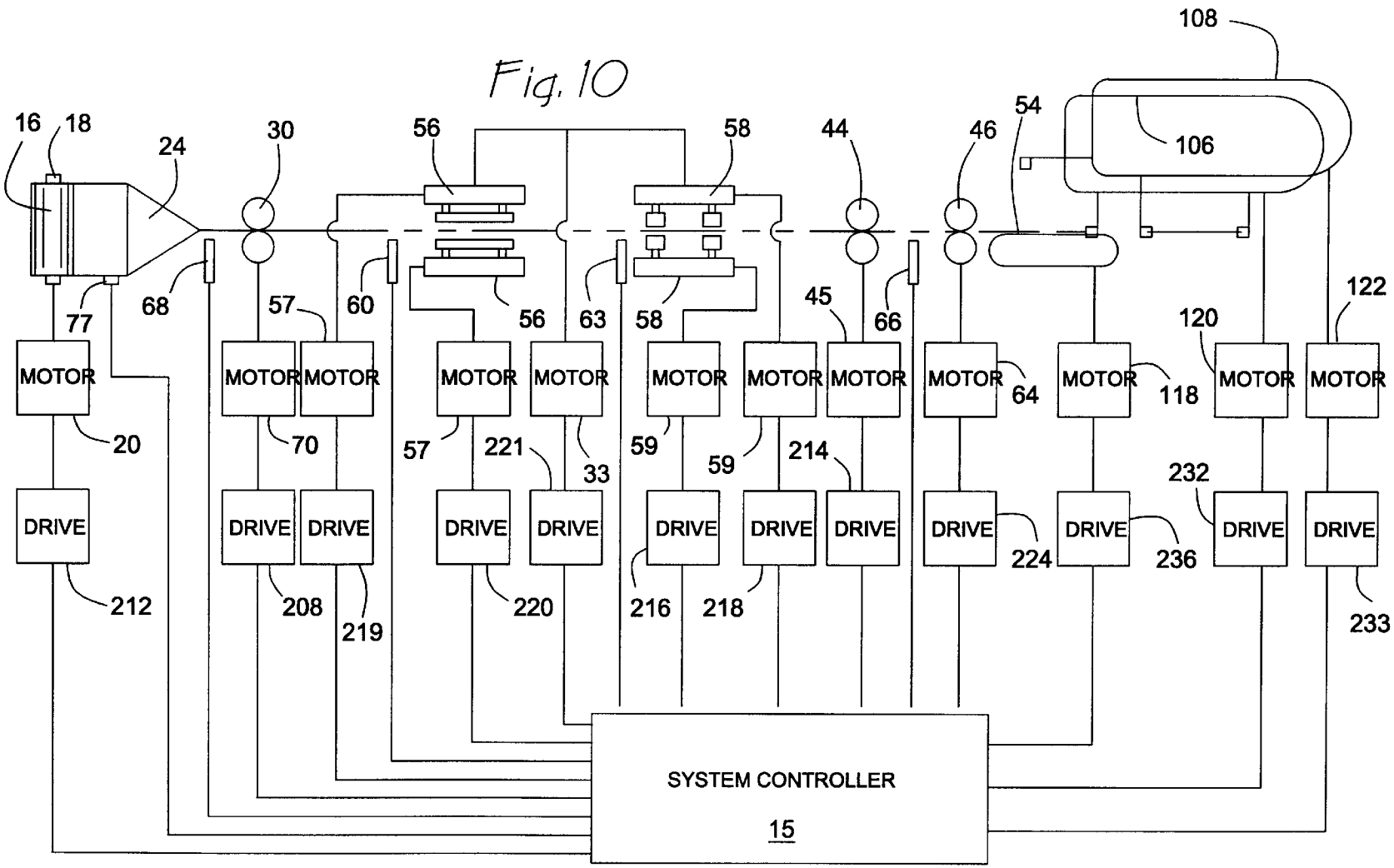
FIG. 10 is a block diagram showing the controls for the machine of FIGS. 1 and 2.

A pair of drive rolls 44 are located downstream of the seal stations to pull the web through the sealing section of the machine 10 (FIG. 2). The drive rolls 44 are positioned to pinch the web 14, thereby frictionally advancing the web. In accordance with certain aspects of the present invention, the drive rolls are operable both continuously and intermittently. In the preferred embodiment, a variable speed motor, such as drive roll servomotor 45, is coupled to and operates the drive rolls (FIG. 10).

Figure 3:
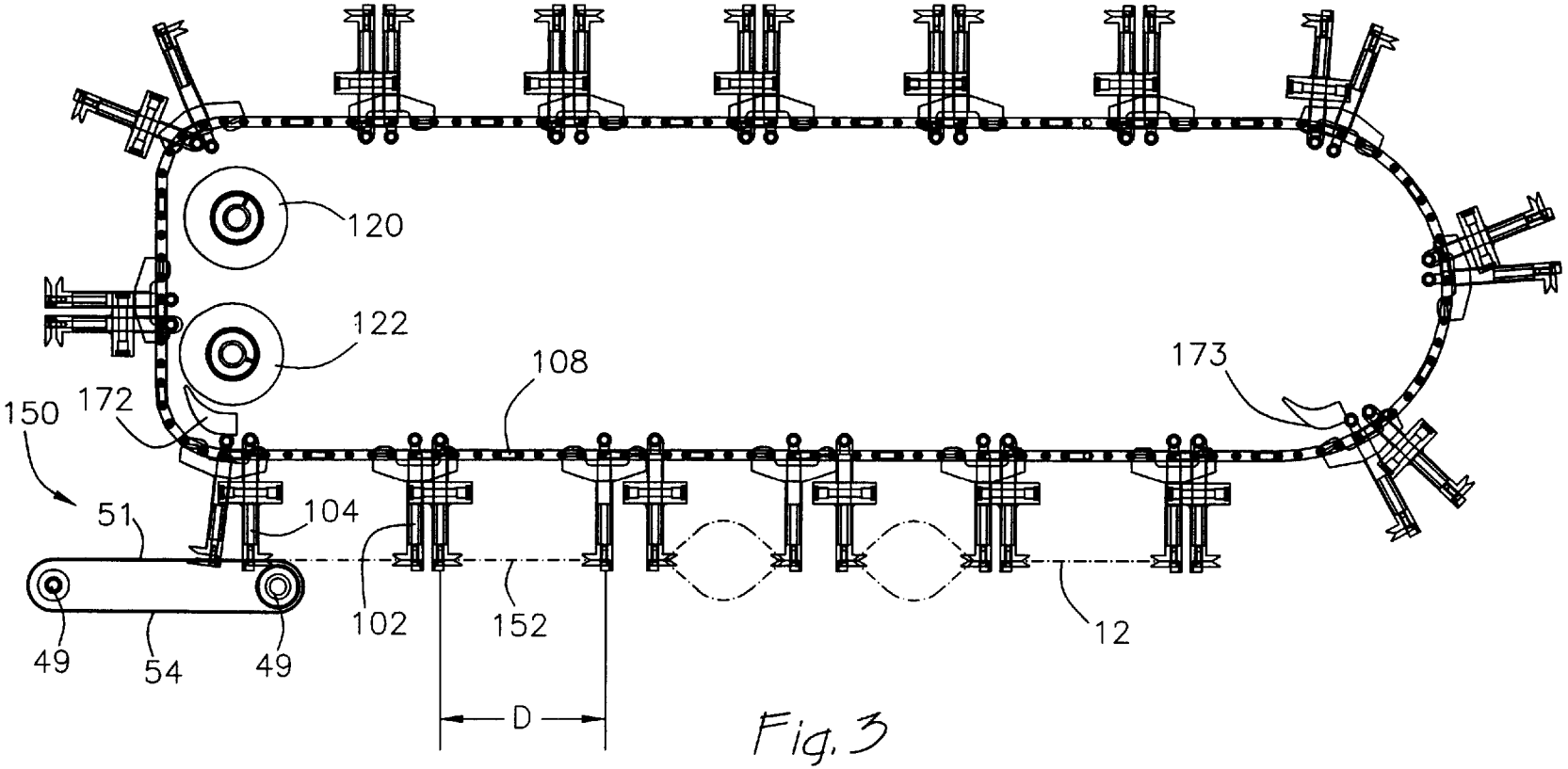
FIG. 3 is a top view of the pouch filling section of FIG. 1.

A cutter is positioned immediately downstream of the drive rolls 44 (FIG. 3). According to the present invention, the cutter is adapted to cut the web at the formed side seals as the web advances. In the currently preferred embodiment, the cutter comprises a pair of cutter rolls 46, a first roll having a plurality of circumferentially spaced blades 48 and a second roll having a plurality of similarly spaced cutting surfaces 50. The cutter rolls 46 are mounted for rotation so that a blade 48 contacts the web 14 at the same time as an associated cutting surface 50 to thereby sever a leading pouch 12 from the web. In the preferred embodiment, a variable speed motor 64 operates the cutter rolls 46 (FIG. 10). Each pouch severed by the cutter rolls 46 is then transferred to a pouch filling section 8 by a transfer mechanism 54, as described in greater detail below.

In the preferred embodiment, the above-described sealing and cutting mechanisms are operated with an adjustable dwell period between subsequent operations. A system controller 15 is programmed to adjust the dwell of the components to thereby adapt the machine 10 for different operating parameters. In the preferred embodiment, the machine 10 uses electronic line shafting to synchronize the motor-driven components. An oscillator generates a pulse stream and is connected to a microprocessor in the system controller 15. The pulse stream corresponds to the web speed such that a given web speed has a corresponding pulse rate. The pulse rate is adjusted proportionally to web speed. As a result, the distance the web advances between pulses is always constant, and components may be placed at locations downstream of a fixed point on the machine which correspond to certain pulse counts. Web speed is defined herein as the instantaneous rate of travel of the web 14 as it advances. Under this definition, web dwell time during intermittent motion is not used to compute the instantaneous web speed.

According to the illustrated embodiment, the machine 10 has an infeed sensor 68 located at a registration point for sensing the registration marks 62 and generating a sync signal as each registration mark passes. The sync signals inform the system that the web is positioned in the machine 10 with a registration mark 62 at the registration point. With a defined registration point, therefore, components may be positioned at known distances downstream of that point and controlled to actuate a determined number of pulses after the registration signal. For example, the first seal station 32 may be positioned 2 feet downstream of the registration point, which may correspond to 1,000 pulses. The system controller 15 may then control the seal station to actuate after 1,000 pulses are counted from the sync signal. The pulse rate is generated such that, for this example, 1,000 pulses correspond to 2 feet of web travel for any web speed.

As noted above, a sync signal indicates that a registration mark 62 is passing the sensor 68. The registration marks 62 are longitudinally spaced at pouch width intervals along the web 14 so that consecutive sync signals indicate that the web has advanced one pouch width, defined herein as a cycle. In the most preferred embodiment, therefore, the web-engaging components are positioned downstream of the infeed at pouch width intervals. As a result, the components are controlled to operate with reference to each sync signal.

The above-described box motion of the seal stations 32, 38 is also preferably timed using the pulse stream.

Accordingly, the carriages 56 of the bottom seal station 32 are controllably positioned a known distance downstream of the infeed sensor 68. As diagrammatically illustrated in FIG. 10, the system controller 15 controls drives 219, 220 to generate a drive signal to the carriage motors 57 to move the carriages 56 downstream at a speed equal to the web speed after a predetermined pulse count. As the carriages 56 move, the system controller 15 signals the reciprocating motor 33 through drive 221 to actuate the bottom seal bars 36 laterally inward after a predetermined number of pulses have elapsed after each sync signal. The motor 33 holds the bottom seal bars 36 in the inward position for another predetermined number of pulses corresponding to a sufficient period of time to form a seal in the web. Once the seal is formed, the bottom seal bars are retracted and the carriages 56 are driven upstream to the initial position. The same procedure is followed after each sync signal. The side seal station is operated in the same fashion. While the use of a pulse stream is preferred, it will be appreciated that other types of controls may be used to actuate the seal stations, such as the use of optical sensors which provide a feedback signal to initiate actuation of the components.

In the preferred embodiment, the drive roll servomotor 45 is also controlled by the system controller 15 using the pulse stream. The user selects a desired web speed and a pulse rate corresponding to that web speed is generated. The system controller 15 delivers a drive signal through drive 214 to the drive roll motor 45 to operate the drive rolls at the appropriate speed (FIG. 10).

FIG. 1 illustrates the currently preferred pouch filling section 8 having pouch carrying apparatus in accordance with the present invention. Severed pouches 12 are received at an inlet 150 of the pouch filling section 8. The pouches are carried by leading and trailing clamps 102, 104 along a clamp path 152 which passes through a conventional pouch filler 110. After leaving the filler, the pouches 12 are sealed and removed for transport at an unloading area 154. A picker (not shown) is located at the transport area 154 for removing filled and sealed pouches from the clamps. In the preferred embodiment, the picker is selectively operable to run either continuously or intermittently.

A transfer mechanism 54 is located at the inlet 150 of the apparatus for transferring severed pouches from an upstream sealing section to the pouch carrying apparatus. The transfer mechanism 54 provides a gripping surface 51 extending between the cutter and the clamps 102, 104. The transfer mechanism 54 is disposed so that the gripping surface 51 moves longitudinally downstream to thereby transport the pouches 12 from the cutter to the inlet of the pouch filling section 8 (FIG. 3). While various means may be used, in the currently preferred embodiment the transfer mechanism comprises a vacuum belt, as illustrated in FIG. 1. The vacuum belt is entrained about a pair of rollers 49. A variable speed motor 118 is preferably coupled to one of the rollers 49 to drive the longitudinal movement of the gripping surface 51 (FIG. 10). It will be appreciated that, because of spacing between the clamps, the clamps are operated at a clamp speed greater than the web speed. The transfer mechanism 54, accordingly, is driven at a transfer speed slightly greater than the clamp speed. When first gripping a pouch, the transfer mechanism 54 slides against the surface of the pouch until the pouch is severed from the web. Similarly, when depositing a pouch in the clamps, the transfer mechanism slides against the pouch until the pouch is carried away.

Figures 5A, 5B:
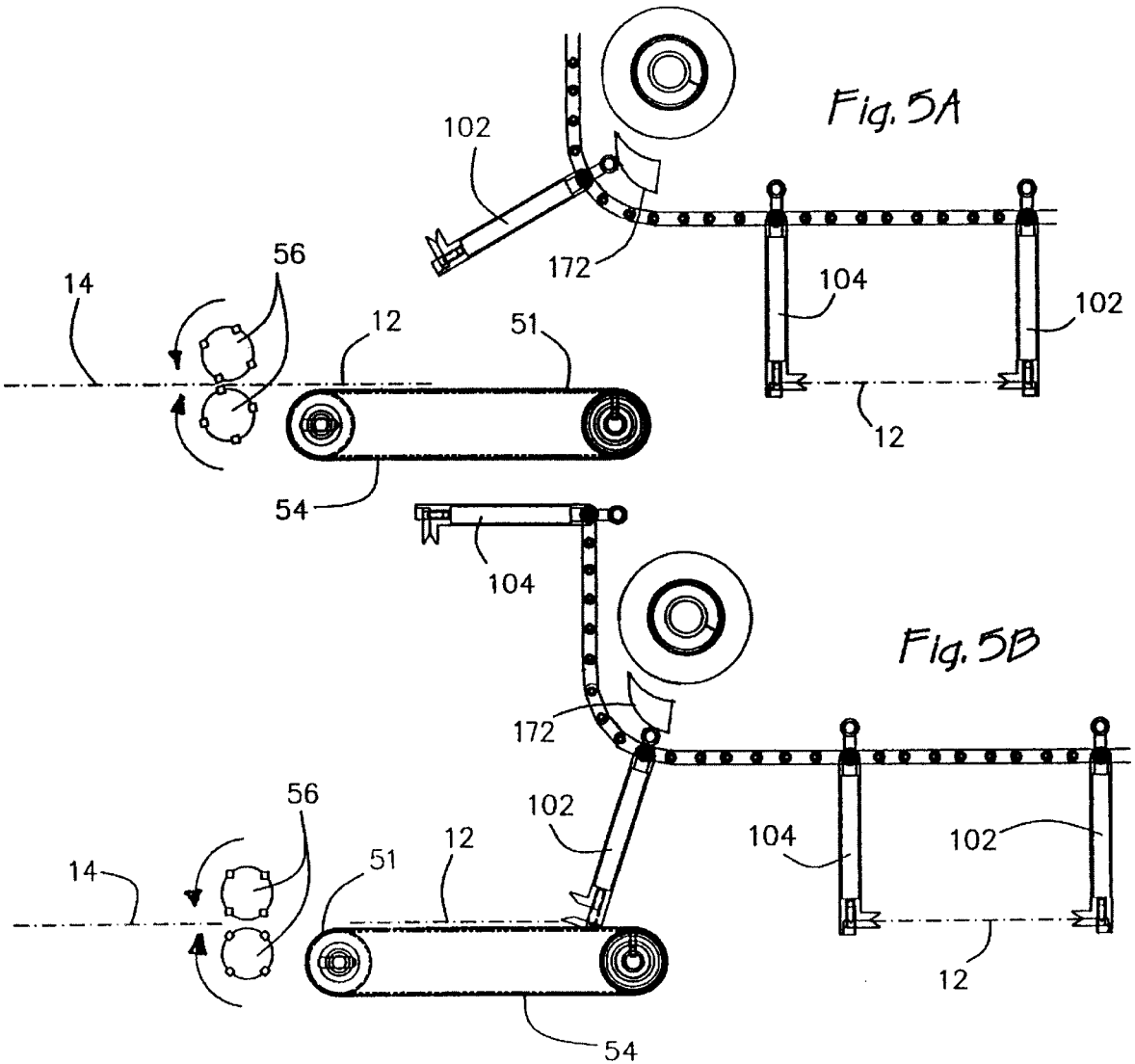
FIGS. 5A–D are a series of schematic representations showing a pouch transfer operation.
Figure 5C:
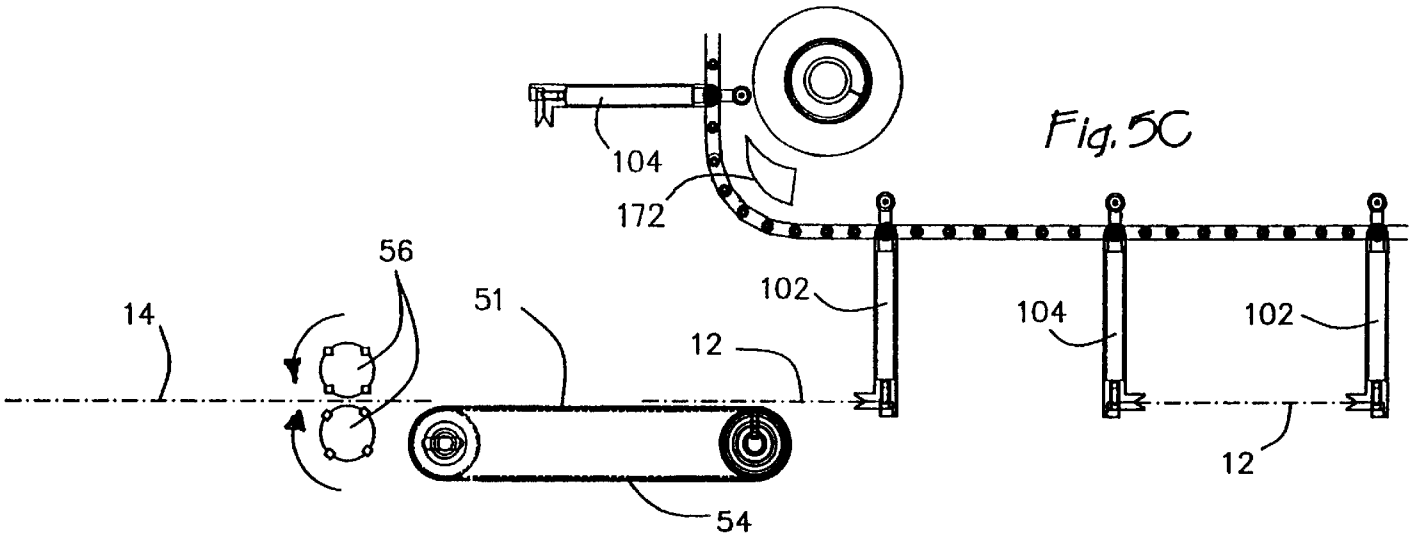
Figure 5D:
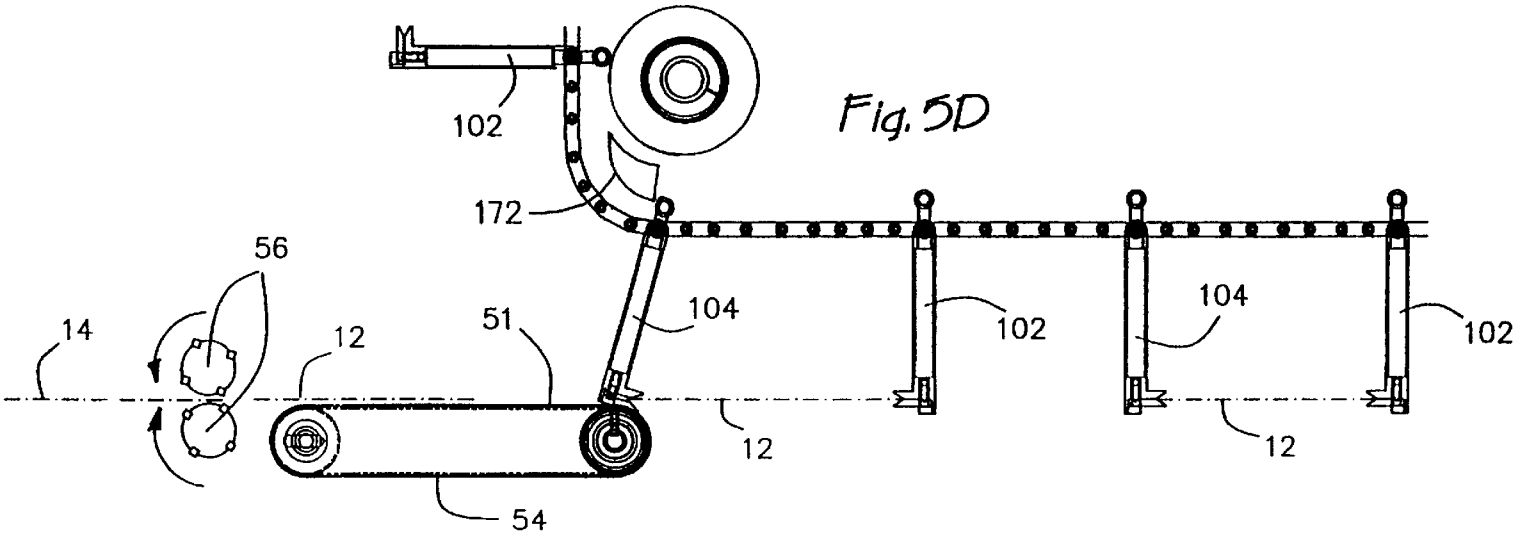

FIGS. 5A–D illustrate a typical pouch transfer. As shown in FIG. 5A, the pouch 12 is about to be severed from the web 14 by the cutter rolls 56. The transfer mechanism 54 engages the leading edge of the unsevered pouch. As the gripping surface 51 rotates, it slides across the face of the pouch 12. The leading clamp 102 moves into position to receive the pouch 12. In FIG. 5B, the pouch 12 has been severed from the web 14 and is transported downstream by the transfer mechanism 54. The clamps continue to move, the leading clamp 102 nearing position to receive the leading edge of the clamp. In FIG. 5C, the leading clamp 102 has received the leading edge of the pouch 12 while the trailing clamp 104 continues to move into position. In FIG. 5D, the trailing clamp 104 has completely rotated and received the trailing edge of the pouch 12. The transfer mechanism 54 still moves in order to transfer subsequently severed pouches. The clamps 102, 104 carry the pouch 12 through the pouch filling section until the pouches are removed for distribution.

In the preferred embodiment, transfer is performed similarly when the pouch carrying apparatus is operated in intermittent mode. In intermittent mode, it will be appreciated that the clamps are intermittently advanced between dwell periods. During the intermittent advances, the clamps travel at the set clamp speed. Accordingly, the transfer mechanism 54 is run at a transfer speed greater than the clamp speed to transfer the pouch to the clamps as the clamps advance. It will be appreciated that the transfer mechanism and clamps may be controlled so that the pouches are transferred to a stationary clamp. In the preferred embodiment, however, the pouches are transferred as the clamps advance, thereby providing apparatus which operates consistently in both continuous and intermittent modes.

As best shown in FIG. 3, the leading and trailing clamps 102, 104 carry the pouches 12 along the clamp path 152. The clamps are supported on endless carriers, illustrated as endless chains 156, 157, 158, and 159 (FIG. 1). The use of four chains as shown is currently preferred, however, more or fewer may be used to accomplish the overall objective of controlling and supporting the clamps 102, 104 and associated pouches 12 as the pouches are filled. Furthermore, other types of endless carriers, such as timing belts and metal strips, may also be used in accordance with the present invention. In the preferred embodiment, each of the chains 156, 157, 158, and 159 is disposed in a horizontal plane and the chains are aligned so that, when viewed from above, only the uppermost chain 156 is visible.

In accordance with certain aspects of the present invention, the chains are motor-driven to quickly and easily adjust a lag distance between leading and trailing clamps 102, 104. As best shown in FIG. 1, all of the leading clamps 102 are attached to a first chain set 106 comprising endless chains 157 and 159. All of the trailing clamps 104 are attached to a second chain set 108 comprising chains 156 and 158. According to the illustrated embodiment, the trailing clamps 104 trail the leading clamps 102 by a lag distance, indicated on FIG. 1 as the letter "D". Leading and trailing variable speed motors 120, 122 are coupled to and drive the first and second chain sets.

Figure 8:
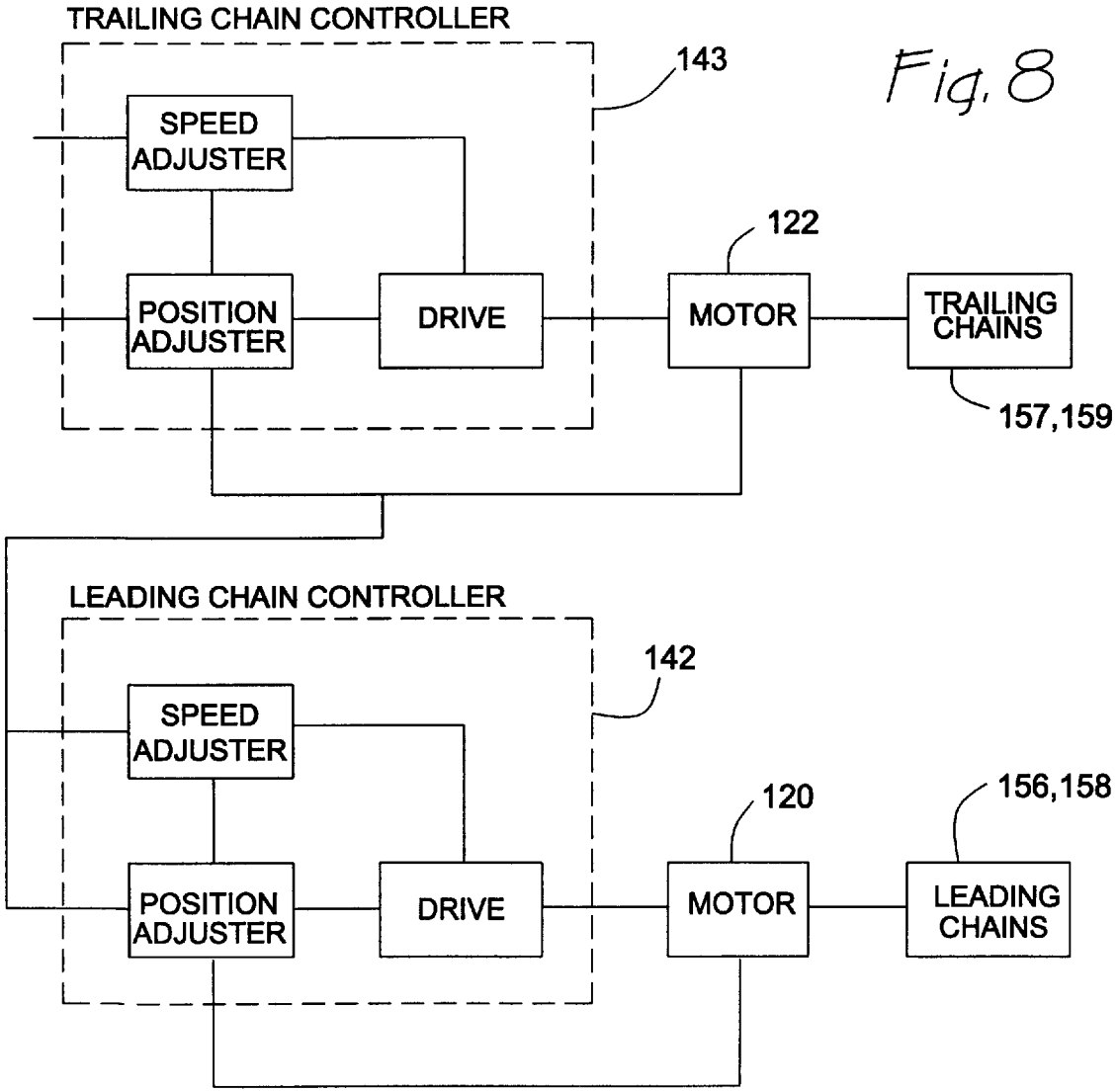
FIG. 8 is a block diagram showing the controls of the leading and trailing chain servomotors.

In the preferred embodiment, the leading and trailing motors 120, 122 are driven by leading and trailing controllers 142, 143. As illustrated in FIG. 8, the leading and trailing chain controllers 142, 143 have drivers for providing a drive signal to the servomotors 120, 122. Each controller further has a position adjuster and speed adjuster which provide input to the driver. In the illustrated embodiment, speed and pouch width information are inputted to the trailing chain controller 143. The position and speed information is forwarded to the driver which generates the drive signal for operating the trailing motor 122. A feedback signal from the trailing motor 122 is fed back into the position adjuster and, subsequently, compared to the desired bag width and speed. The position and speed adjusters compensate for differences between the actual and desired operating parameters and alter the drive signal accordingly. Feedback from the trailing motor 122 is also delivered to the leading chain controller 142. The drive of the leading chain controller 142 provides a drive signal which operates the leading motor 120. Again, a feedback signal from the leading motor 120 is returned to the position and speed adjusters to compare the actual and desired parameters and alter the drive signal as necessary. In the alternative, the leading and trailing motors 120, 122 may be controlled by the system controller 15 rather than separate controllers, as illustrated in FIG. 10.

In operation, it will be appreciated that the leading and trailing motors 120, 122 normally operate at the same speed so that the pouches 12 are not stretched, torn, or dropped. When a different pouch width is desired, the phase between the leading and trailing servomotors 120, 122 is adjusted to change the lag distance D between the leading and trailing clamps 102, 104. Such a chain adjustment alters the lag distance D for all of the associated pairs of leading and trailing clamps simultaneously. As a result, the present invention allows quick and easy adjustment of the clamps for pouches of various sizes.

In accordance with additional aspects of the present invention, one of the clamps in each associated pair of clamps is fixed while the other is moveable, to thereby allow the pouches to be opened and closed while held in the clamps. In the currently preferred embodiment, the leading clamps 102 are fixed. Each leading clamp comprises a support 160 attached to the chains. An arm 162 extends from the support 160 and terminates with a first jaw 166. In the currently preferred embodiment illustrated in FIGS. 4A and B, the support 160 has a general "I" shape to provide multiple attachment points to the chains. The support has tabs 169, 170 having slots for attaching the support 160 to the chains. Tab 170 has a pinched slot to provide a snap fit with the chains. Tab 169 has an extended slot to allow for adjustment as the leading clamp travels around the corners of the chain path. As a result, the supports are quickly and easily installed and removed. A moveable jaw 167 is mounted on the end of a rod 168. The rod 168 is slidable in a bore extending through the arm 162. The bore has a shoulder against which a compression spring 171 bears. The compression spring 171 engages a snap ring that is fit into an annular groove on the rod 168. The compression spring 171 biases the moveable jaw 167 against the fixed jaw 166 to thereby secure an edge of a pouch in the trailing clamp. An opposite end of the rod 168 supports a follower 175. The follower 175 is positioned to engage cams 172, 173 (FIG. 3) spaced about the pouch filling module which momentarily open the jaw 167 to allow insertion or removal of a pouch edge.

Further in regard to the currently preferred embodiment, the trailing clamps 104 are slidable to allow pouch opening and closing operations. Accordingly, the trailing clamp 104 comprises a bracket 176 having tabs 173, 174. The tabs 173, 174 have slots which adapt the bracket 176 for attachment to the chains. Tab 174 is pinched to provide a snap fit with the chains. Tab 173 is slotted to allow for adjustment around corners of the claim path. Upper and lower guide arms 179, 180 (FIG. 4B) are attached to the bracket 176. A clamp holder 130 has upper and lower support bores sized to closely fit the upper and lower guide arms 179, 180, thereby slidably mounting the clamp holder 130 on the guide arms. The clamp holder 130 has a support 185 for holding the leading clamp 102. The clamp holder 130 has a fixed jaw 186 and movable jaw 187 actuated by another follower 175. The clamp holder therefore operates similar to the fixed clamp described above.

Figure 4A:
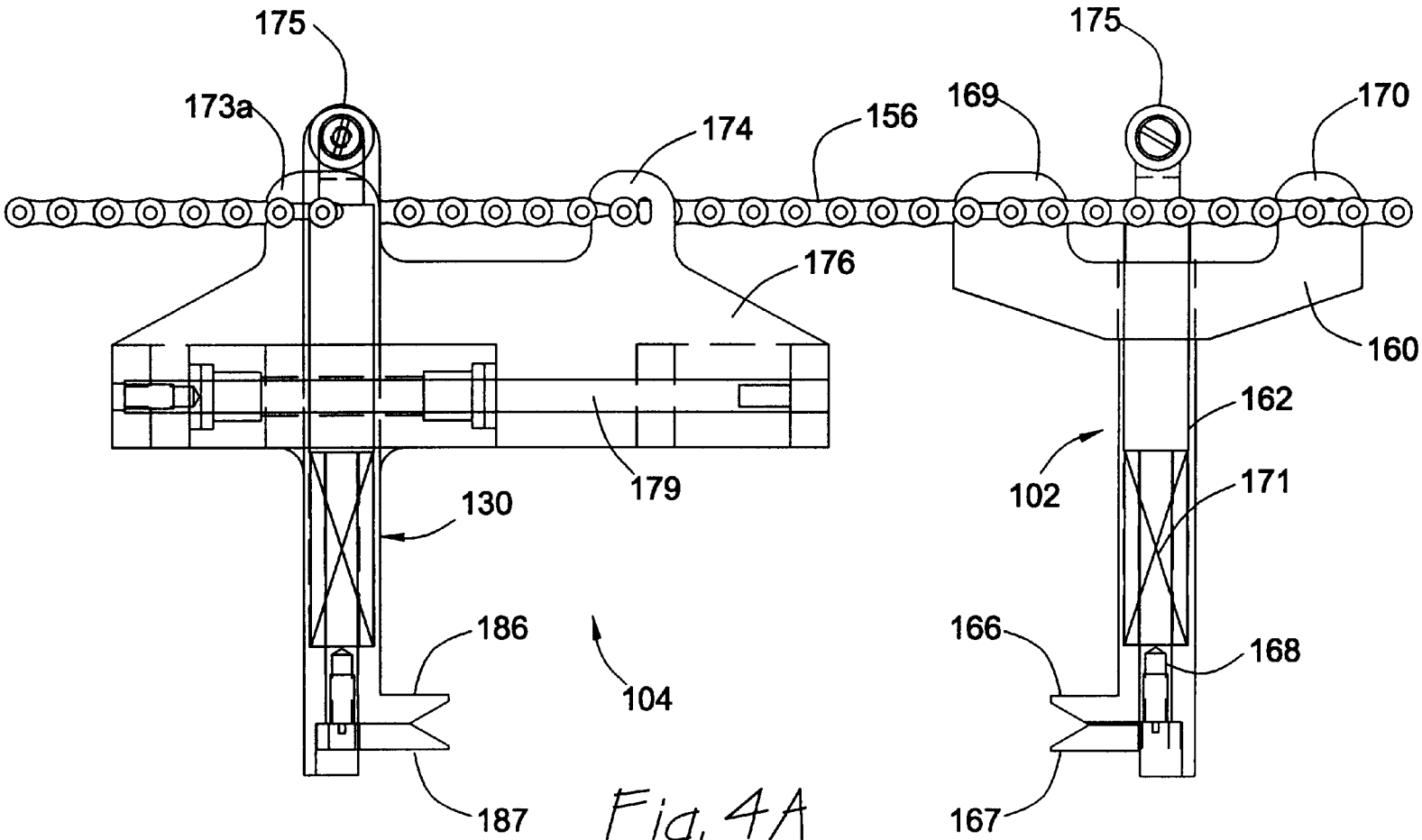
FIGS. 4A and B are enlarged top and side views of an associated pair of leading and trailing clamps.
Figure 4B:
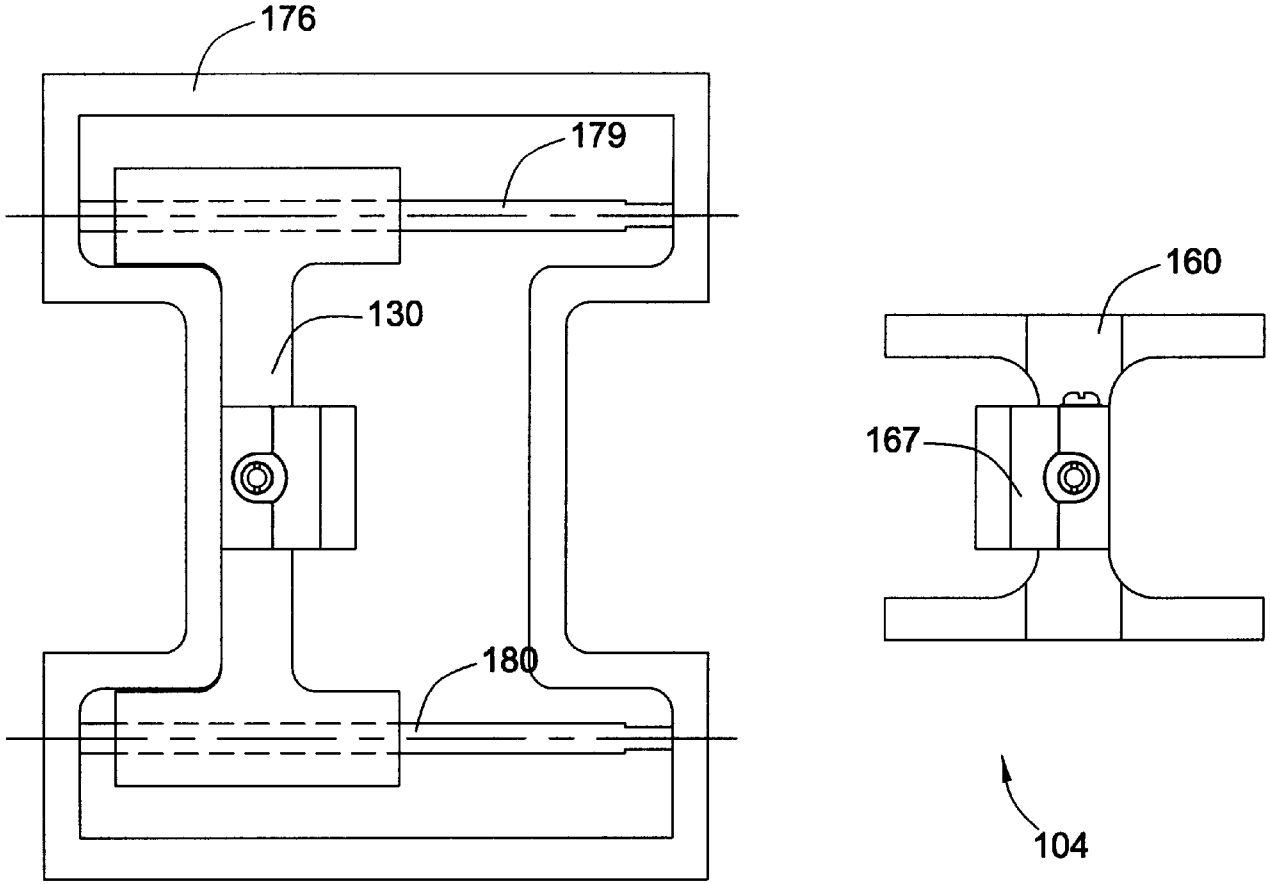

From the above, it will be appreciated that FIG. 1 presents a partially schematic representation of the leading and trailing clamps 102, 104. In addition, it will be appreciated that certain structural elements have been removed in FIGS. 3, 5A–D, 6A–D, and 7A–B for clarity. The currently preferred embodiment of the clamps, however, are illustrated in FIGS. 4A and B.

The above-described clamp holder 130 slides between pouch closed and pouch open positions. In the closed pouch position, as best illustrated by the left-hand pouch in FIG. 1, the clamp holder 130 is positioned near the upstream extent of the guide arms 179, 180. In this position, the side panels of the pouch are substantially flat to present a closed top pouch edge. The clamp holder 130 is slidable on the guide arms 179, 180 to an open pouch position best illustrated by the pouch positioned under the filter 110 in FIG. 1. In the open pouch position, the clamp holder 130 is positioned midway along the guide arms 179, 180 and closer to the leading clamp 102. The side panels of the pouch bow outward to present an open top edge.

In operation, the clamp holder 130 is in the closed pouch position as the pouches 12 are transferred from the sealing section 6. Before the pouch reaches the pouch filler 110, the clamp holder 130 is moved to the open position to facilitate filling of the pouch. The clamp holder 130 remains in the open position as the clamps pass under the pouch filler and the pouches are filled with product. After exiting the pouch filler 110, the clamp holder 130 is repositioned back toward the closed position to allow the top edge to be sealed.

From the above, it will be appreciated that the present invention provides a split clamp for carrying pouches. As noted above, the leading and trailing clamps 102, 104 have separate supports in the form of the individual chains 156, 157, 158, and 159. There is no common chain or frame to support the leading and trailing clamps, as is conventional. The split clamp of the present invention, therefore, may be quickly and easily adjusted for different pouch widths. In addition, the split clamp still provides for a slidable leading clamp which allows pouch opening and closing operations through the pouch filling section 8. Furthermore, the leading and trailing clamps snap onto their respective chains, thereby allowing the number of clamps attached to the chains to be quickly and easily changed.

Figures 6A, 6B, 6C, 6D, 7A, 7B, 7C:
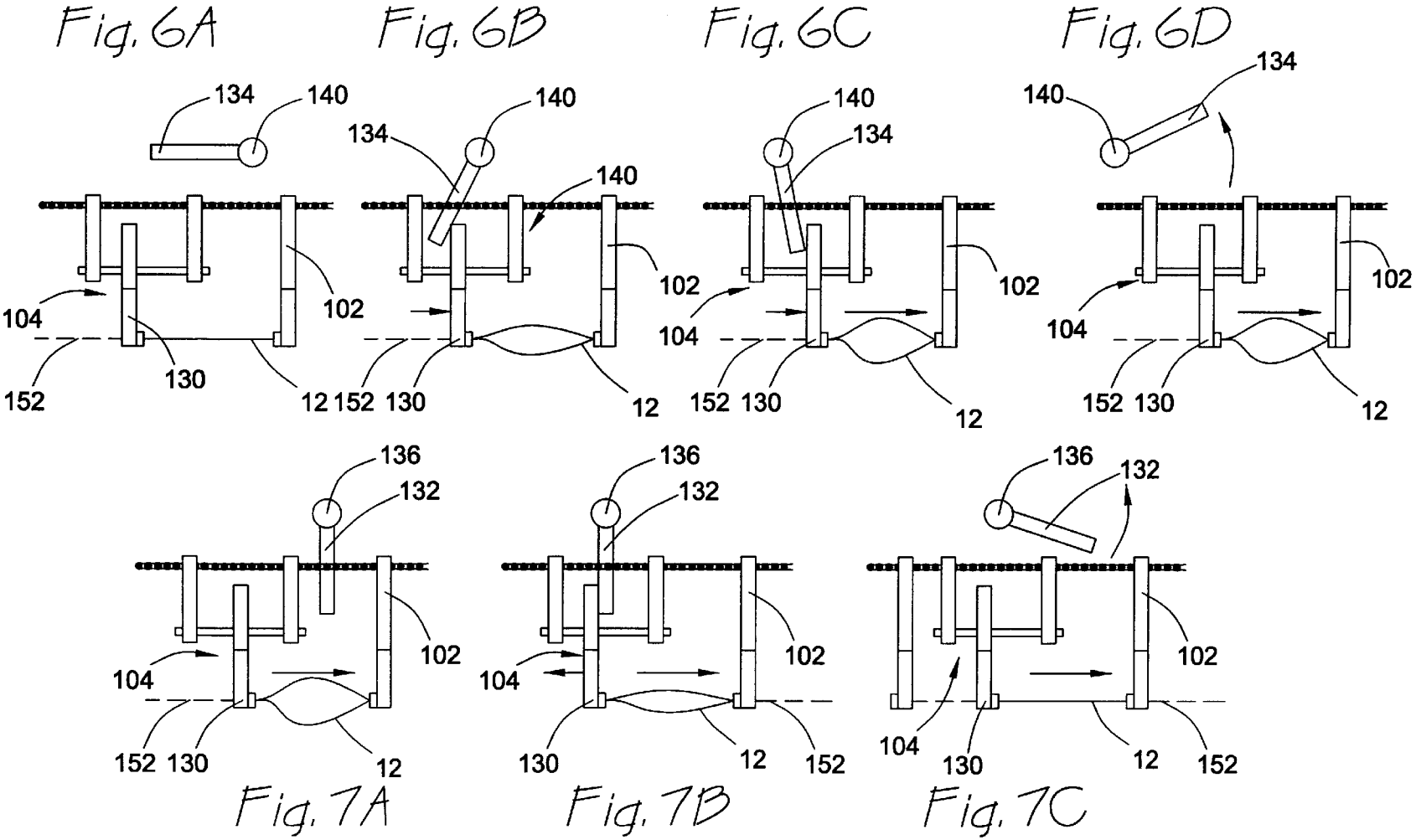
FIGS. 6A–D are a series of schematic representations depicting operation of a pouch-closing mechanism.
FIGS. 7A–C are a series of schematic representations depicting operation of a pouch-opening mechanism.

In accordance with certain aspects of the present invention, upstream and downstream mechanisms reposition the clamp holder 130 between the open and closed pouch positions. In the currently preferred embodiment, the upstream pouch-opening mechanism comprises an advance arm 132 positioned before the pouch filler 110. The advance arm 134 has an initial position in which the arm is positioned outside of the clamp path 152, as shown in FIG. 6A. As a clamp holder 130 passes, the advance arm 134 rotates into engagement with the clamp holder 130 (FIG. 6B). The advance arm 134 continues to rotate to slide the clamp holder downstream along the guide arms 179, 180 toward the open pouch position (FIG. 6C). The advance arm 134 executes a complete revolution to return to the initial position, awaiting a subsequent clamp holder 130. In this manner, the advance arm 134 advances all of the clamp holders 130 as they pass. In an alternative embodiment, the advance pouch opening mechanism comprises dual advanced arms which rotate one-half revolution per cycle.

The pouch-closing mechanism is located downstream of the pouch filler 110. In the preferred embodiment, the downstream mechanism comprises a retard arm 132. In an initial position, as best shown in FIG. 7A, the retard arm 132 extends into the clamp path 152 as the clamp holder 130 approaches. The retard arm 132 remains in the initial position to engage the clamp holder 130 for a delay period, during which progress of the clamp holder 130 is impeded, to thereby slide the clamp holder 130 toward the closed pouch position (FIG. 7B). Once the clamp holder 130 is in the closed pouch position, the retard arm 132 rotates out of the clamp path 152 to allow the leading and trailing clamps 102, 104 to pass (FIG. 6C). The retard arm 132 makes a full revolution to return to the initial position, to await the next clamp holder 130. In this manner, a single retard arm repositions each of the clamp holders 130 as they pass. In an alternative embodiment, the pouch closing mechanism has dual retard arms spaced by 180 degrees. In such an embodiment, the arms rotate one-half revolution per cycle.

In the preferred embodiment, the retard and advance arms 132, 134 are operated by variable speed motors. The retard and advance motors 136, 140 are responsive to signals delivered from the system controller 15. The signals correspond to clamp speed so that the servomotors 136, 140 are synchronized with the clamps.

After being placed in the closed position, the pouches are carried through a top seal station 111 located downstream of the advance arm 100 (FIG. 1). In the illustrated embodiment, the top seal station comprises a pair of radiant heaters 112 positioned near the top and on each side of the pouch. The radiant heaters 112 elevate the temperature of a top seal area of the pouch to place it in condition for sealing. The pouches 12 are then carried through a pair of top seal rollers 114 which compress the sides of the pouch together to form a top seal 115.

While the top seal station 111 as illustrated is preferred, other structure may be used to form the top seal 115 in accordance with the present invention. For example, seal bars may be used which engage the pouch to form the seal. The seal bars may be driven in a box motion similar to that described above with respect to the bottom and side seal bars 36, 42. If such sealing bars are used, the need for top seal rollers 114 is eliminated.

Returning to the illustrated embodiment, pouches exiting the top seal rollers 114 are carried through a pair of cool rolls 116. The cool rolls engage the top seal area of the pouch to set the top seal formed therethrough. The top seal rollers 114 and cool rolls 116 are preferably connected to variable speed motors connect to the system controller. At the unloading area 154 downstream of the cool rolls 116, the pouches 12 are removed from the clamps 102, 104 and collected for transport.

In light of the above, it will be appreciated that the present invention provides a new and improved pouch filling apparatus. The apparatus provides leading and trailing clamps mounted on separate endless carriers. The endless carriers are independently driven and controlled so that the trailing clamps lag the leading clamps by a phase distance. The controls may be used to simply and easily adjust the phase distance to adapt the apparatus for bags of different sizes. The trailing clamp is slidable on a pair of guide arms to allow the clamped pouches to be opened for filling and subsequently closed for sealing. An advance arm is mounted to the support structure of the apparatus upstream of the pouch filler. The advance arm engages the clamp holder to advance the holder toward the open pouch position. The pouches remain in the open position as they are filled and until they reach the retard arm. The retard arm is also mounted to the support structure of the apparatus and is positioned downstream of the pouch filler. The retard arm engages the clamp holder to momentarily impede its progress, thereby sliding the holder toward the closed pouch position. Variable speed motors are drivingly connected to each of the components of the pouch filling apparatus to thereby adapt it for both continuous and intermittent operation.

What is claimed is:

1. Apparatus for carrying pouches along a path over which empty pouches are received and filled prior to being discharged, the pouches having a given width, the apparatus comprising:

a support carrying first and second endless carriers in substantially horizontal paths;

a plurality of leading clamps attached to and spaced equally about the first endless carrier;

a plurality of trailing clamps attached to and spaced equally about the second endless carrier to form associated pairs of leading and trailing clamps, each trailing clamp trailing an associated leading clamp by a lag distance; and first and second carrier variable speed motors driving the first and second endless carriers, respectively, a controller for driving the first and second endless carriers at the same speed, but allowing adjustment therebetween to simultaneously alter the lag distance between all leading and all trailing clamps, thereby to provide for running adjustment of pouch width.

2. The filling apparatus of claim 1 in which one clamp of each pair is a movable clamp while the other is a fixed clamp, the movable clamp being controllably repositionable between a closed pouch position in which the clamps of a pair are separated by the pouch width, and an open pouch position in which the movable clamp is transported toward the fixed clamp to open the pouch for filling.

3. The apparatus of claim 2 in which the movable clamp of each pair is the trailing clamp, the trailing clamp comprising a bracket attached to the first endless carrier, a pair of parallel guide arms attached to the bracket, and a clamp holder slidable on the guide arms between the closed and open pouch positions.

4. The apparatus of claim 2 further comprising a motor-driven upstream mechanism for translating the movable clamp to the open pouch position before the pouch is filled.

5. The apparatus of claim 4 in which the upstream mechanism comprises an advance arm, the advance arm triggerable to execute a full rotation, the advance arm extending into the path and advancing in a same direction as the clamp holder during an active portion of the rotation, the advance arm triggered to execute the full rotation as the clamp holder passes to thereby advance the trailing clamp toward the open pouch position.

6. The apparatus of claim 4 further comprising a motor-driven downstream mechanism for translating the movable clamp to the closed pouch position after the pouch is filled.

7. The apparatus of claim 6 in which the downstream mechanism comprises a retard arm, the retard arm supported in an initial position in which the retard arm extends into the path, the retard arm movable to a retracted position outside of the path, the motor-driven retard arm controlled to pause in the initial position for a delay period before moving to the retracted position, the retard arm thereby engaging and translating the trailing clamp to the closed pouch position.

8. The apparatus of claim 1 in which the pouches are provided at a web speed and the associated pairs of clamps operate at a clamp speed, a transfer mechanism located at an inlet of the filling apparatus operating at a transfer speed greater than the clamp speed to transfer each pouch to the clamps.

9. The apparatus of claim 8 in which transfer mechanism comprises a vacuum belt.

10. A method for adjusting a pouch filling station for different pouch sizes, the pouch filling station having a plurality of leading clamps attached to a first endless carrier and a plurality of trailing clamps attached to a second endless carrier, the first and second endless carriers positioned to form associated pairs of leading and trailing clamps separated by a lag distance, the method comprising:

driving the first endless carrier at a leading clamp speed;

driving the second endless carrier at a trailing clamp speed substantially equal to the leading clamp speed;

momentarily modifying the speed of at least one of the endless carriers to thereby adjust the lag distance between the clamps.

11. The method of claim 10 in which first and second variable speed motors drive the first and second endless carriers, respectively.

12. The method of claim 11 in which a controller is coupled to the first and second endless carrier motors, the controller controlling the speeds of the motors to thereby adjust the lag distance between the clamps.

13. A split clamp for carrying pouches having a pouch width, the split clamp comprising:

a leading clamp comprising a fixed jaw and a moveable jaw on a bracket, the bracket attached to a leading endless carrier;

a trailing clamp comprising a fixed jaw and a movable jaw supported on a bracket, the bracket attached to a trailing endless carrier, the leading and trailing clamps forming an associated pair of clamps in which the trailing clamp trails the leading clamp by a lag distance, the trailing clamp controllably repositionable between a closed pouch position in which the leading and trailing clamps are separated by the pouch width, and an open pouch position in which the trailing clamp is transported toward the fixed clamp to open the pouch for filling;

the movable jaw of the leading and trailing clamps being biased against the fixed jaw but operable to an open position in which the moveable jaw is spaced from the fixed jaw to allow a pouch edge to be inserted therebetween; and leading and trailing actuators respectively driving the leading and trailing endless carriers at substantially equal leading and trailing clamp speeds to maintain the lag distance between the leading and trailing clamps.

14. The split clamp of claim 13 in which the leading and trailing actuators comprise leading and trailing variable speed motors having leading and trailing controllers, respectively, the leading and trailing controllers maintaining a phase distance between the leading and trailing motors to thereby maintain the lag distance.

15. The split clamp of claim 13 in which the trailing clamp further comprises a pair of guide arms attached to the bracket, and a clamp holder slidably mounted on the guide arms and adapted to carry the fixed and moveable jaws.

* * * * *